US006158972A

United States Patent [19]

Ruth

[11] Patent Number: 6,158,972

[45] Date of Patent: Dec. 12, 2000

[54] TWO STAGE PULSE PUMP

[75] Inventor: Harvey L. Ruth, Maryland Heights, Mo.

[73] Assignee: Federal-Mogul World Wide, Inc., Southfield, Mich.

[21] Appl. No.: 09/268,479

[22] Filed: Mar. 16, 1999

[51] Int. Cl.[7] ..... F04B 3/00

[52] U.S. Cl. ..... 417/246; 417/380; 417/395

[58] Field of Search ..... 417/244, 246, 417/395, 274, 275, 276, 277, 380; 123/198, 509; 103/150; 222/207

[56] References Cited

U.S. PATENT DOCUMENTS

| | | | |
|---|---|---|---|
| 1,965,569 | 7/1934 | Anderson | 60/19 |
| 2,079,858 | 5/1937 | Horton | 158/36.4 |
| 2,713,858 | 7/1955 | Armstrong | 123/139 |
| 3,182,601 | 5/1965 | Johnson | 103/150 |
| 3,241,494 | 3/1966 | Johnson | 103/150 |
| 3,561,648 | 2/1971 | Humphrey | 222/207 |
| 3,924,975 | 12/1975 | Hundertmark | 417/395 |
| 4,054,116 | 10/1977 | Coddington | 123/198 |
| 4,085,586 | 4/1978 | Shibata | 60/277 |
| 4,093,403 | 6/1978 | Schrimpf et al. | 417/246 |
| 4,097,198 | 6/1978 | Herron | 417/245 |
| 4,124,008 | 11/1978 | Fujikawa | 123/139 |
| 4,473,340 | 9/1984 | Walsworth | 417/274 |
| 4,479,765 | 10/1984 | Robertson | 417/380 |
| 4,551,076 | 11/1985 | DuBois | 417/395 |
| 4,597,719 | 7/1986 | Tano | 417/317 |
| 5,259,352 | 11/1993 | Gerhardy et al. | 123/509 |
| 5,419,686 | 5/1995 | Wissmann | 417/380 |
| 5,615,643 | 4/1997 | Hill | 123/65 B |
| 5,707,217 | 1/1998 | Loeffler | 417/339 |

*Primary Examiner*—Timothy S. Thorpe
*Assistant Examiner*—Ethud Gartenberg
*Attorney, Agent, or Firm*—Howard & Howard

[57] ABSTRACT

A fluid actuated fuel pump assembly including a body 12 having saucer-like sections 54 defining separate concave inlet 14 and outlet 16 hollows and a cylindrical central section 52 defining a fuel intake passage 48 for admitting fuel and extending in the opposite direction to a fuel outlet passage 50. A first pulse cover 18 is disposed over the inlet hollow 14 and a first flexible diaphragm 20 is sandwiched between the first pulse cover 18 and one saucer-like section 54 to define a first pulse chamber 22 and a first pumping chamber 24. A second pulse cover 26 is disposed over the outlet hollow 16 and a second flexible diaphragm 28 is sandwiched between the second pulse cover 26 and the other saucer-like section 54 to define a second pumping chamber 30 and a second pulse chamber 32. The first pulse cover 18 includes a first pressure inlet 42 communicating with the first pulse chamber 22 and is adapted for connection to a first source of regularly cycling pressure pulses of one cylinder of an internal combustion engine to move the first diaphragm 20 and the second pulse cover 26 includes a second pressure inlet 44 communicating with the second pulse chamber 32 and is adapted for connection to a source of regularly cycling pressure pulses of another cylinder of the engine to move the second diaphragm 28. A fuel transfer valve 88, through which fuel is pumped from the first pumping chamber 24 to the second pumping chamber 30 in response to the first diaphragm 20 being moved toward the inlet hollow 14, is disposed between the inlet 14 and outlet 16 hollows.

In other words, the transfer valve 88 is centrally disposed relative to the diaphragms 20 and 28, i.e., on an axis extending transversely and centrally of the diaphragms 20 and 28.

20 Claims, 2 Drawing Sheets

TWO STAGE PULSE PUMP

BACKGROUND OF THE INVENTION

1. Field of the Invention

The subject invention relates to fluid actuated diaphragm pumps and, more specifically, to a dual diaphragm pump defining a pulse chamber associated with each of the two diaphragms with each pulse chamber being responsive to cyclic pressure variations of the cylinders of an internal combustion engine.

2. Description of the Prior Art

Fluid actuated, diaphragm pumps including at least two diaphragms connected in series and actuated by separate sources of pressure which are oscillating out of phase from each other are well known. An example of same is disclosed in U.S. Pat. No. 2,713,858 to Armstrong et al. An efficient combination of components is disclosed schematically in U.S. Pat. No. 4,093,403 to Schrimpf el al. However, there remains a need for a design which allows the components to be efficiently manufactured and assembled.

SUMMARY OF THE INVENTION AND ADVANTAGES

The invention is implemented by a fluid actuated fuel pump assembly. A first flexible diaphragm defines a first pulse chamber and a first pumping chamber. A fuel intake passage admits fuel into the first pumping chamber as the first diaphragm moves to vary the volume of the first pumping chamber. A second flexible diaphragm is parallel to the first diaphragm and defines a second pumping chamber and a second pulse chamber. A fuel outlet passage conveys fuel from the second pumping chamber as the second diaphragm moves to vary the volume of the second pumping chamber. A first pressure inlet communicates with the first pulse chamber and is adapted for connection to a first source of regularly cycling pressure pulses to move the first diaphragm. A fuel transfer valve through which fuel is pumped from the first pumping chamber to the second pumping chamber in response to the first diaphragm being moved is disposed between and is aligned with the center of the pressure chambers.

Accordingly, there is provided a pump employing an arrangement of the components which is efficient to manufacture and assemble.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
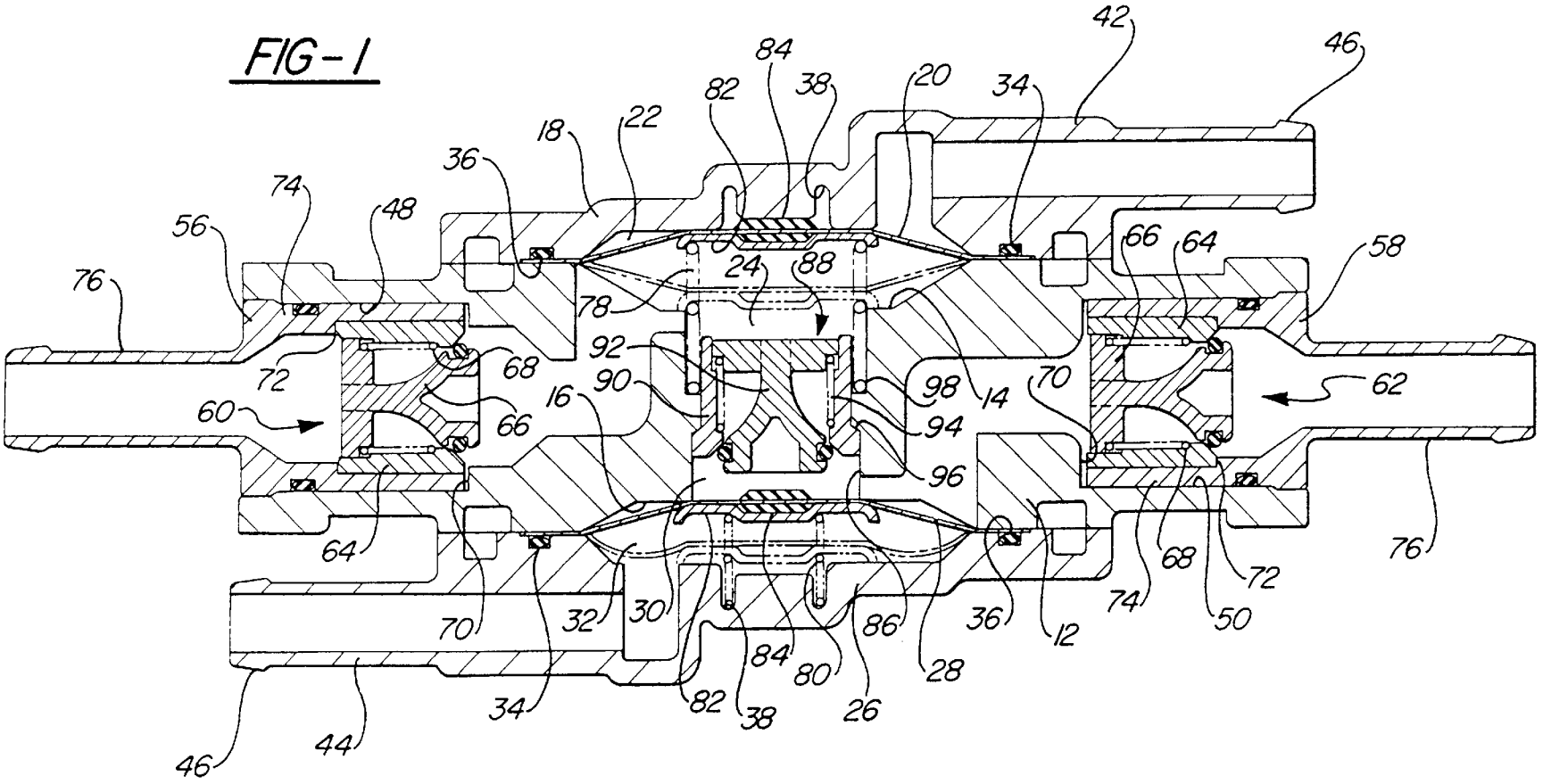
FIG. 1 is cross sectional view of the subject invention.
Figure 2:
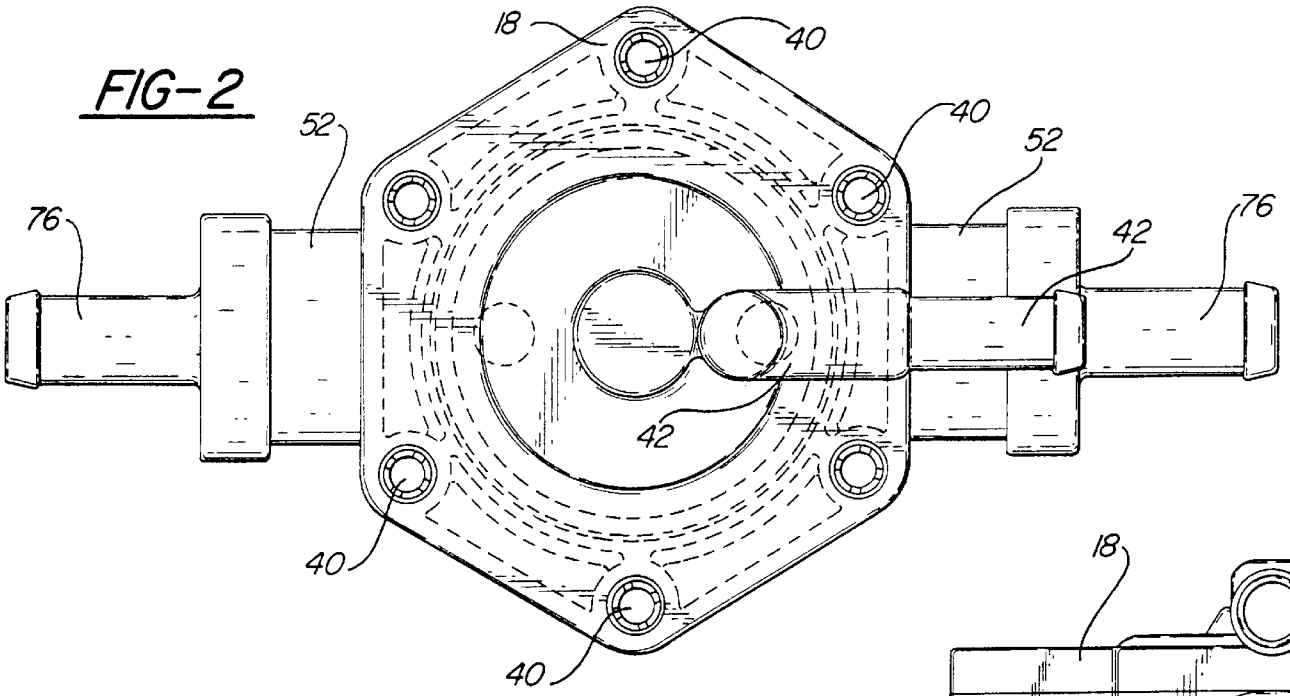
FIG. 2 is a smaller scale top view of FIG. 1.

Referring to the Figures, wherein like numerals indicate like or corresponding parts throughout the several views, a fluid actuated fuel pump assembly is shown.

The assembly comprises a body 12 consisting of a plastic material and defining separate concave inlet 14 and outlet 16 hollows. A first pulse cover 18 is disposed over the inlet hollow 14. A first flexible diaphragm 20 is sandwiched between the first pulse cover 18 and the body 12 to define a first pulse chamber 22 thereabove with the first pulse cover 18 and a first pumping chamber 24 therebelow with the inlet hollow 14.

A second pulse cover 26 is disposed over the outlet hollow 16. A second flexible diaphragm 28 sandwiched between the second pulse cover 26 and the body 12 to define a second pumping chamber 30 with the outlet hollow 16 and a second pulse chamber 32 with the second pulse cover 26.

The first 18 and second 26 pulse covers consist of a plastic material and are identical and interchangeable. Each of the covers 18 and 26 includes a bead recess 34 facing the body 12 and each of the diaphragms 20 and 28 includes an integral bead 36 disposed in the bead recess 34 of the associated cover to retain the diaphragms 20 and 28 in position. Each pulse cover 18 and 26 also includes a spring seat consisting of an annular groove 38. The pulse covers 18 and 26 have a hexagonal periphery and are bolted to the body 12 by fasteners 40.

The first pulse cover 18 includes a first pressure inlet 42 communicating with the first pulse chamber 22 and is adapted for connection to a first source of regularly cycling pressure pulses to move the first diaphragm 20. In the same fashion, the second pulse cover 26 includes a second pressure inlet 44 communicating with the second pulse chamber 32 and is adapted for connection to a source of regularly cycling pressure pulses to move the second diaphragm 28. More specifically, the inlets 42 and 44 are identical and comprise a tubular length terminating in a distal end having a rib 46 for retaining a flexible hose, tube, or the like. Also, the inlets are parallel and axially aligned but extend in opposite directions.

Figure 3:
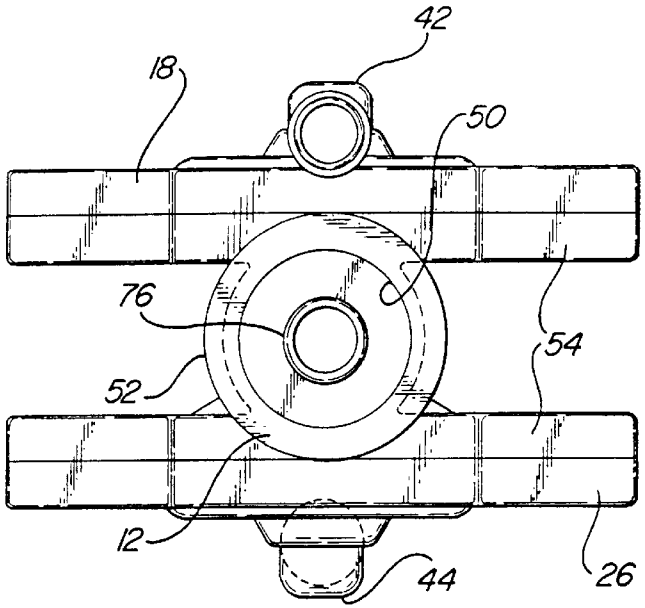
FIG. 3 is a smaller scale end view of FIG. 1.

The body 12 defines a fuel intake passage 48 through which fuel is admitted into the first pumping chamber 24 as the first diaphragm 20 moves away from and toward the inlet hollow 14 to vary the volume of the first pumping chamber 24. In the same fashion, the body 12 defines fuel outlet passage 50 through which fuel is pumped from the second pumping chamber 30 as the second diaphragm 28 moves away from and toward the outlet hollow 16 to vary the volume of the second pumping chamber 30. The passages 48 and 50 are parallel, axially aligned and extend in opposite directions. Further, both of the passages 48 and S0 and the inlets 42 and 44 are all parallel to one another. As shown in FIG. 3, the body comprises a central section 52 which is cylindrical and more narrow than the saucer shaped of pancake portions 54 disposed on either side thereof and which define the hollows 14 and 16. The axis of the central section 52 is also parallel to the passages 48 and 50 and the inlets 42 and 44. The covers 18 and 26 are secured to the saucer-shaped pancake portions 54 and both extend radially outwardly of the central section 52 of the body 12.

The central section 52 of the body 12 ends in the passages 48 and 50 and an inlet fitting 56 is disposed in the inlet passage and an outlet fitting 58 is disposed in the outlet passage 50. An inlet check valve, generally indicated at 60, is disposed in the inlet fitting 56 and an outlet check valve, generally indicated at 62, is disposed in the outlet fitting 58.

The check valves 60 and 62 are identical to one another with the inlet check valve 60 disposed to allow fluid flow only into the first pressure chamber 24 and with the outlet check valve 62 disposed to allow fluid flow only out of the second pressure chamber 30. The body 12 consists of a plastic material and the fittings 56 and 58 consist of a metal, e.g., brass, with the fittings 56 and 58 are forced into the passages 48 and 50 to prevent the fittings 56 and 58 from being removed from the body 12.

Each of the valves 60 and 62 include brass cage 64, a poppet 66 slidably supported in the cage 64 and held against a valve seat by a coil spring 68. The body presents shoulders 70 in the passages 48 and 50, and the fittings 56 and 58 present interior shoulders 72 with the cages 64 retained between the shoulders 70 of the body 12 and the shoulders 72 of the fittings 56 and 58. Each of the fittings 56 and 58 includes a supporting portion 74 supported by the body 12 and a tubular portion 76 extending therefrom for connection to a fluid line.

The assembly also includes a first biasing means 78 consisting of a first coil spring for biasing the first diaphragm 20 in a direction away from the inlet hollow 14 and second biasing means 80 consisting of a second coil spring for biasing the second diaphragm 28 in a direction toward the outlet hollow 16. The biasing force of the second coil spring 80 is less than the biasing force of the first coil spring 78.

A spring retainer plate 82 is disposed between each of the first and second springs 78 and 80 and each of the diaphragms 20 and 28. A button 84 extends from opposite sides of each diaphragm 20 and 28 for engaging the associated pulse cover and for engaging the adjacent retainer plate 82. The buttons 84 may be formed integrally with the diaphragms 20 and 28 or separately and fused to the diaphragms 20 and 28. The second spring 80 is seated in the annular spring seat or groove 38 of the second pulse cover 26 to act against the retainer plate 82 against the second diaphragm 28.

The body 12 defines a transfer passage 86 extending perpendicular to and between the inlet 14 and outlet 16 hollows. A transfer valve, generally indicated at 88, is disposed in the transfer passage 86 between the inlet 14 and outlet 16 hollows. Fuel is pumped through the transfer valve 88 from the first pumping chamber 24 to the second pumping chamber 30 in response to the first diaphragm 20 being moved toward the inlet hollow 14. The assembly is characterized by the transfer passage 86, the transfer valve 88, the first 78 and second 80 springs, and the buttons 84 all being axially aligned, i.e., on a single axis, which is also perpendicular or transverse to the diaphragms 20 and 28. Said another way, the transfer valve 88 is disposed between and in the axially aligned with the center of the pressure chambers 24 and 30. The inlet 48 and outlet 50 passages and the first pressure inlet 42 and the second pressure inlet 44 are all parallel to one another and transverse to the transfer passage 86 as the inlet 48 and outlet 50 passages extend in opposite directions, and the first pressure inlet 42 and the second pressure inlet 44 extend in opposite directions.

The transfer valve 88, like the check valves 60 and 62, comprises a first cage 90 seated in the transfer passage 86 and presenting a valve seat a first poppet 92 movably supported by the cage 90 and biased against the valve seat by a coil valve spring 94. More specifically, the first poppet 92 has a valve head for sealing engagement with the valve seat and a stem slidably supported in the cage. The valve spring 94 interacts between the stem and the cage 90 for urging the valve head into sealing engagement with the valve seat.

The transfer passage 86 presents a cage shoulder 96 and the cage 90 presents a complementary cage abutment seated on the cage shoulder 96. The cage 90 is also made of brass and is press fit into the transfer passage 86 of the plastic body 12. The transfer passage 86 also presents a spring shoulder 98 and the first spring 78 is seated on the spring shoulder 98, the other end of the first spring 78 engaging the first diaphragm 20.

As alluded to above first and second sources of air pressure from different cylinders of an internal combustion engine are connected to the pressure inlets 76. For example, the first source could be air pressure from the number one cylinder while the second source could be air pressure from the number four cylinder. The number one cylinder would be at a maximum positive pressure while at top dead center (TDC) and the number four cylinder would be at a maximum negative (vacuum) pressure while at bottom dead center (BDC), and vice versa. Said another way, the second source of pressure pulses is of substantially equal intensity as the first source of pressure pulses and at least 180 degrees out of phase from the first source of pressure pulses. The first diaphragm 20, in response to the cyclical pressure variations in the first pulse chamber 22, alternately moves away from the inlet hollow 14 to draw fuel into the first pressure chamber 24 through the fuel intake check valve 60 to pump fuel from the first pressure chamber 24 through the transfer valve 88. The second diaphragm 28 moves sequentially with respect to the first diaphragm 20 and in response to cyclical pressure variations in the second pulse chamber 32 and alternatively moves away from the hollow 16 to admit fuel being pumped through the fuel transfer valve 88 by the first diaphragm 20 to pump fuel from the second pumping chamber 30 through the fuel outlet valve 62.

The first 20 and second 28 diaphragms are movable between positions adjacent the respective of the first 14 and second 16 hollows and a position generally adjacent the respective pulse covers 18 and 26. The first 78 and second 80 springs respectively bias the first 20 and second 28 diaphragms in the same axial direction relative to the transfer valve 88 with the first diaphragm 20 in the full position ready to pump fuel from the full pressure chamber 24 through the transfer valve 88 and the second diaphragm 28 in the empty position ready to receive fuel from the transfer valve 88.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A fluid actuated fuel pump assembly comprising;

a body (12) defining separate concave inlet (14) and outlet (16) hollows, a first pulse cover (18) disposed over said inlet hollow (14), a first flexible diaphragm (20) sandwiched between said first pulse cover (18) and said body (12) to define a first pulse chamber (22) with said first pulse cover (18) and a first pumping chamber (24) with said inlet hollow (14), said body (12) defining a fuel intake passage (48) for admitting fuel into said first pumping chamber (24) as said first diaphragm (20) moves away from and toward said inlet hollow (14) to vary the volume of said first pumping chamber (24), a second pulse cover (26) disposed over said outlet hollow (16), a second flexible diaphragm (28) sandwiched between said second pulse cover (26) and said body (12) to define a second pumping chamber (30) with said outlet hollow (16) and a second pulse chamber (32) with said second pulse cover (26), said body (12) defining a fuel outlet passage (50) for conveying full from said second pumping chamber (30) as said second diaphragm (28) moves away from and toward said outlet hollow (16) to vary the volume of said second pumping chamber (30), said first pulse cover (18) including a first pressure inlet (42) communicating with said first pulse chamber (22) and adapted for connection to a first source of regularly cycling pressure pulses to move said first diaphragm (20), said second pulse cover (26) including a second pressure inlet (44) communicating with said second pulse chamber (32) and adapted for connection to a source of regularly cycling pressure pulses to move said second diaphragm (28), a fuel transfer valve (88) through which fulel is pumped from said first pumping chamber (24) to said second pumping chamber (30) in response to said first diaphragm (20) being moved toward said inlet hollow (14), including first biasing means (78) for biasing said first diaphragm (20) in a direction away from said inlet hollow (14), and second biasing means (80) for biasing said second diaphragm (28) in a direction toward said outlet hollow (16), said first (78) and second (80) biasing means and said transfer valve (88) being axially aligned.

2. A fuel pump assembly as set forth in claim 1 including first biasing means (78) for biasing said first diaphragm (20) in a direction away from said inlet hollow (14), and second biasing means (80) for biasing said second diaphragm (28) in a direction toward said outlet hollow (16), the biasing force of said second biasing means (80) being less than the biasing force of said first biasing means (78), said first (78) and second (80) biasing means and said transfer valve (88) being axially aligned.

3. A fuel pump assembly as set forth in claim 2 wherein said body (12) defines a transfer passage (86) extending between said inlet (14) and outlet (16) hollows and said transfer valve (88) includes a first poppet (92) disposed in said transfer passage (86).

4. A fuel pump assembly as set forth in claim 3 wherein said transfer passage (86) presents a spring shoulder and said first biasing means (78) consists of a first coil spring seated on said spring shoulder and engaging said first diaphragm (20).

5. A fuel pump assembly as set forth in claim 4 including a cage (90) seated in said transfer passage (86) and presenting a valve seat, said poppet (92) movably disposed in said cage (90), said poppet (92) having a valve head for sealing engagement with said valve seat and a stem slidably supported in said cage (90), a valve spring (94) interacting between said stem and said cage (90) for urging said valve head into sealing engagement with said valve seat.

6. A fuel pump assembly as set forth in claim 5 wherein said transfer passage (86) presents a cage shoulder and said cage presents a cage shoulder seated on said cage shoulder.

7. A fuel pump assembly as set forth in claim 6 wherein said body (12) consists of a plastic material and said cage consists of a metal.

8. A fuel pump assembly as set forth in claim 4 wherein said second pulse cover (26) includes a spring seat and said second biasing means (80) consists of a second coil spring seated on said spring seat and engaging said second diaphragm (28).

9. A fuel pump assembly as set forth in claim 8 wherein said first (18) and second (26) pulse covers are identical and interchangeable.

10. A fuel pump assembly as set forth in claim 8 wherein said spring seat consists of an annular groove (38) receiving said second coil spring.

11. A fuel pump assembly as set forth in claim 3 wherein each of said covers includes a bead recess (34) facing said body (12) and each of said diaphragms (20) and (28) includes an integral bead (36) disposed in said bead recess (34) of the associated cover.

12. A fuel pump assembly as set forth in claim 11 wherein said second biasing means (80) consists of a second coil spring, a spring retainer plate (82) disposed between each of said first and second springs and each of said diaphragms (20) and (28), a button axially aligned with said first (78) and second (80) biasing means and said transfer valve (88) and extending from opposite sides of each diaphragm (20) and (28) for engaging the associated pulse cover and for engaging the adjacent retainer plate (82).

13. A fuel pump assembly as set forth in claim 3 wherein said inlet (48) and outlet (50) passages and said first pressure inlet (42) and said second pressure inlet 44 are all parallel to one another.

14. A fuel pump assembly as set forth in claim 13 including an inlet fitting (56) disposed in said inlet passage and an outlet fitting (58) disposed in said outlet passage (50), an inlet check valve (60) disposed in said inlet fitting (56) and an outlet check valve (62) disposed in said outlet fitting (58).

15. A fuel pump assembly as set forth in claim 14 wherein said check valves (60 and 62) are identical to one another with said inlet check valve (60) disposed to allow fluid flow only into said first pressure chamber and with said outlet check valve (62) disposed to allow fluid flow only out of said second pressure chamber.

16. A fuel pump assembly as set forth in claim 15 wherein said body (12) consists of a plastic material and said fittings (56) and (58) consist of a metal.

17. A fuel pump assembly as set forth in claim 14 wherein each of said fittings (56) and (58) includes a large supporting portion (74) supported by said body (12) and a tubular portion (76) extending therefrom for connection to a fluid line.

18. A fluid actuated fuel pump assembly comprising;

a body (12) defining a spherical concave inlet hollow (14) facing in one direction and a spherical concave outlet hollow (16) facing in the opposite direction, a first pulse cover (18) in seating engagement with said body (12) about said inlet hollow (14) and presenting spherical concave inlet depression over said inlet hollow, a first flexible diaphragm (20) sandwiched between said first pulse cover (18) and said body (12) to define a first pulse chamber (22) with said inlet depression of said inlet pulse cover and a first pumping chamber (24) with said inlet hollow (14), body (12) defining a fuel intake passage (48) for admitting fuel into said first pumping chamber (24) as said first diaphragm (20) moves away from and toward said inlet hollow (14) to vary the volume of said first pumping chamber (24), a second pulse cover (26) in seating engagement with said body (12) about said outlet hollow and presenting a spherical outlet depression over said outlet hollow (16), a second flexible diaphragm (28) sandwiched between said second pulse cover (26) and said body (12) to define a second pumping chamber (30) with said outlet hollow (16) and a second pulse chamber (32) with said outlet depression of said second pulse cover (26), said body (12) defining a fuel outlet passage for conveying fuel from said second pumping chamber (30) as said second diaphragm (28) moves away from and toward said outlet hollow (16) to vary the volume of said second pumping chamber (30), said first pulse cover (18) including a first pressure inlet (42) communicating with said first pulse chamber (22) and adapted for connection to a first source of regularly cycling pressure pulses to move said first diaphragm (20), said second pulse cover (26) including a second pressure inlet (44) communicating with said second pulse chamber (32) and adapted for connection to a source of regularly cycling pressure pulses to move said second diaphragm (28), a transfer passage 86 extending between said inlet (14) and outlet (16) hollows, and a first poppet valve disposed in said transfer passage (86) for allowing fuel flow from said first pumping chamber (24) to said second pumping chamber (30) in response to said first diaphragm (20) being moved toward said bottom of said inlet hollow (14), said inlet and outlet passages and said first pressure inlet (42) and said second pressure inlet (44) are all parallel to one another and transverse to said transfer passage (86), said inlet and outlet passages extending in opposite directions, and said first pressure inlet (42) and said second pressure inlet (44) extend in opposite directions.

19. A fuel pump assembly as set forth in claim 18 including an inlet fitting (56) disposed in said inlet passage and an outlet fitting (58) disposed in said outlet passage (50), an inlet check valve (60) disposed in said inlet fitting (56) for allowing flow only into said first pressure chamber and an outlet check valve (62) disposed in said outlet fitting (58) for allowing only flow out of said second pressure chamber, each of said fittings (56) and (58) including a large supporting portion (74) supported by said body (12) and a tubular portion (76) extending therefrom for connection to a fluid line.

20. A fluid actuated fuel pump assembly comprising;

a first flexible diaphragm (20) defining a first pulse chamber (22) and a first pumping chamber (24), a fuel intake passage (48) for admitting fuel into said first pumping chamber (24) as said first diaphragm (20) moves to vary the volume of said first pumping chamber (24), a second flexible diaphragm (28) parallel to said first diaphragm (20) and defining a second pumping chamber (30) and a second pulse chamber (32), a fuel outlet passage for conveying fuel from said second pumping chamber (30) as said second diaphragm (28) moves to vary the volume of said second pumping chamber (30), first pressure inlet (42) communicating with said first pulse chamber (22) and adapted for connection to a first source of regularly cycling pressure pulses to move said first diaphragm (20), a fuel transfer valve (88) through which fuel is pumped from said first pumping chamber (24) to said second pumping chamber (30) in response to said first diaphragm (20) being moved, said assembly characterized by said transfer valve (88) being disposed between and in alignment with the center of said pressure chambers (24 and 30).

* * * * *